US006151910A

United States Patent [19]

Hazen

[11] Patent Number: 6,151,910

[45] Date of Patent: Nov. 28, 2000

[54] KIT FOR CONVERTING USED BUCKETS INTO COOLERS

[76] Inventor: Steven R. Hazen, 3340 N. Country Club, Tucson, Ariz. 85716

[21] Appl. No.: 09/436,382

[22] Filed: Nov. 9, 1999

[51] Int. Cl.[7] ..... F25D 3/08; B65D 25/14

[52] U.S. Cl. ..... 62/457.2; 62/530; 62/457.4; 62/457.7; 62/371; 220/592.2; 220/495.03

[58] Field of Search ..... 62/457.2, 457.4, 62/457.5, 457.7, 530, 371; 220/592.09, 592.2, 495.03

[56] References Cited

U.S. PATENT DOCUMENTS

| | | | |
|---|---|---|---|
| 2,652,698 | 9/1953 | Schlumbohm | 62/80 |
| 3,998,072 | 12/1976 | Shaw | 62/457 |
| 4,238,934 | 12/1980 | Hotta | 62/457 |
| 4,741,176 | 5/1988 | Johnson et al. | 62/457 |
| 4,892,226 | 1/1990 | Abtahi . | |
| 5,009,326 | 4/1991 | Reaves et al. . | |
| 5,490,396 | 2/1996 | Morris | 62/457.2 |
| 5,533,361 | 7/1996 | Halpern | 62/457.2 |
| 5,595,069 | 1/1997 | Gies | 62/530 |
| 5,758,513 | 6/1998 | Smith | 62/457.5 |
| 5,944,251 | 8/1999 | LaFleur . | |

*Primary Examiner*—William Doerrler
*Assistant Examiner*—Chen-Wen Jiang
*Attorney, Agent, or Firm*—Antonio R. Durando

[57] ABSTRACT

A kit converts an empty container, such as a 5-gallon paint bucket, into a cooler through the installation of an insulated, pocketed liner with a stiff and flexible top border that is capable of folding over the lip of the container. One or more ice packs are placed in the container to keep it refrigerated.

20 Claims, 2 Drawing Sheets

KIT FOR CONVERTING USED BUCKETS INTO COOLERS

BACKGROUND OF THE INVENTION

1. Field of Invention

This invention generally relates to the field of conversion kits and in particular to a kit that converts a used bucket into a cooler for the transportation and storage of beverages or perishable items.

2. Description of the Related Art

Containers designed to keep items stored within them cold, commonly referred to as "coolers," exist in many varieties. Most coolers consist of a hollow, insulated box or cylinder and a lid. Typically, ice is placed within the insulated area to maintain cold temperatures for the items stored within the cooler. Other features may include a carrying handle, compartments to keep items separated from the cooling source, or reusable freezer packs in lieu of ice.

One example of a typical cooler found in the prior art is U.S. Pat. No. 4,238,934 by Hotta. This invention consists of a constant temperature box comprising a body and a lid closing an upper opening thereof, the body and lid being made of steel, synthetic resin, and an insulating material so as to be of adiabatic construction. The box is incorporated with a hollow, flat, and small in height container which serves as a reservoir for a cooling or hearing source and which is disposed horizontally at the upper portion of the body, thereby cooling or warming foodstuffs and beverages kept within the box.

Another basic type of cooler is detailed in U.S. Pat. No. 2,652,698 to Schlumbohm, which discloses a portable cylindrical icebox consisting of two nested, metal food containers. The bottom of the upper container protrudes for a limited length into the tapered open end of the lower container, thereby establishing a metal-to-metal contact for the purpose of heat conductivity. Thus, by putting ice in the upper container, food carried in the lower container will stay cool. Both containers are insulated by cork jackets, with a cork plate on the lower container and a cork lid and the upper container.

More specialized coolers also have been developed. For example, U.S. Pat. No. 3,998,072 issued to Shaw, describes a portable single-bottle cooler comprising a carrying case in which a plurality of flasks of coolant are removably disposed about the bottle. Similarly, U.S. Pat. No. 4,741,176 by Johnson et al. provides an individual-beverage cooler that consists of a cylindrical freezer pack insert placed into a cup with a cover. The cylindrical freezer-pack insert includes removable sections to change its size so as to accommodate a different size cup, bottle or can.

More recently, multipurpose refrigerated containers have become available. Two examples are U.S. Pat. No. 5,533,361 by Halpern and U.S. Pat. No. 5,595,069 issued to Gies. Halpern's cooler includes a deformable but resilient insulated pouch, which houses freezable gel packs, and a mounting assembly coupled to the container for securing it to both the handlebar and to a portion of the upper basket of a grocery cart.

The cooler of Gies consists of an adjustable, refreezable structure comprised of a flexible cover having an inner and an outer layer of urethane-coated nylon fabric. The main utility of this cooler is that it can be wrapped around objects of varying sizes, such as beverage cans, frozen dinners, and the like.

All of the examples described above contain novel elements specifically constructed for specialized applications or to overcome specific problems. However, the structures and configurations of these prior-art coolers leave many significant problems that are overcome by the invention described herein. First, the metallic, nested, and jacketed cooler of Schlumbohm is relatively complicated in construction and expensive to produce if made in a size large enough to store significant amounts of refrigerated items. Second, the coolers of Shaw and Johnson et al. are manufactured to hold single items, and, thus, are obviously limited in their capacity. Third, Halpern and Gies do not show or suggest how their specialized inventions might be used to fit and modify a large container so as to accommodate, organize, and protect from breakage many different items simultaneously. Finally, the bulk, weight, and unorganized interior of the constant temperature box of Hotta can make portability awkward.

In contrast, the present invention aims at conveniently storing and transporting multiple refrigerated items without the added cost, bulk, or weight inherent in the manufacture of nested or adiabatic structures. Moreover, glass and other breakables are kept separated and cushioned in this invention. Finally, nothing in the prior art demonstrates how a container such as an empty bucket can simply and inexpensively be converted into a useful article, i.e. an efficiently organized and lightweight cooler.

BRIEF SUMMARY OF THE INVENTION

It is an object of the invention to provide a simple and inexpensive means of making a cooler.

A second object of the invention is to provide a cooler that is durable, yet lightweight and easy to carry.

Another object of the invention is to provide a cooler with means to organize the contents placed therein.

Still another object of the invention is to prevent breakage of glass or damage to other stored items by providing a means of separating and cushioning the contents placed therein.

Yet another object of the invention is to provide a means of converting a discarded item into a useful article.

In accordance with these objectives, the invention utilizes an insulated liner designed to slip over the rim of a bucket through the presence of a non-insulated top border that overlaps the rim and holds the liner in place. Pockets are built into the liner to receive items, such as bottles and cans, and a freezer pack is provided to fit at both the bottom and on the lid of the bucket.

One of the utilities of this invention is that it is particularly inexpensive and easy for one to turn any suitable container into a cooler. For example, used 5 gallon buckets commonly available at construction sites can be made into coolers simply by securing the insulated liner and cold packs of the present invention to the rim of and inside the bucket.

A second advantage of this invention is that it utilizes the inherent strength and portability of containers that were designed to carry heavy loads, such as large paint buckets, sand buckets and the like. Thus, the conversion of these containers affords a cooler that will be durable, easy to carry by virtue of a built-in handle, and made from lightweight material such as plastic.

Another advantage is that this invention provides a pocketed liner that organizes the interior of the cooler so that products are not buried or hard to find, thus limiting the amount of time that the cooler is opened to find and select a particular item. Consequently, the contents of the cooler will stay cooler longer.

Moreover, the pocketed liner provides secure and protective storage of glass or other breakable containers. First, the insulation content of the liner provides effective padding against damage caused by shocks to the cooler. Second, placing items in the pockets of the liner prevents them from coming into contact with each other and breaking, such as could happen if items were stored loose and the cooler is dropped.

Finally, with landfill space becoming increasingly scarce, the invention of converting a discarded container into a useful item helps to reduce waste. Furthermore, re-using a container for another purpose also saves the costs and energy associated with recycling waste containers.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced.

DETAILED DESCRIPTION OF THE INVENTION

The invention is based on the idea of converting containers, such as empty 5-gallon buckets found at a construction site, into useful items. Accordingly, a kit consisting of an insulated, pocketed liner with a non-insulated top border for securing the liner in place and one or more cooling means is provided to easily and inexpensively transform such containers into portable coolers.

Figure 1A:
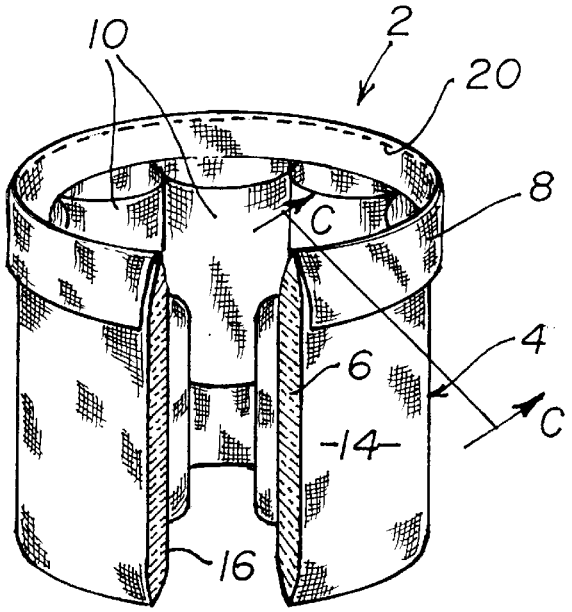
FIG. 1A is a partially cut-away, perspective front view of the liner component of the preferred embodiment of the invention.
Figure 1B:
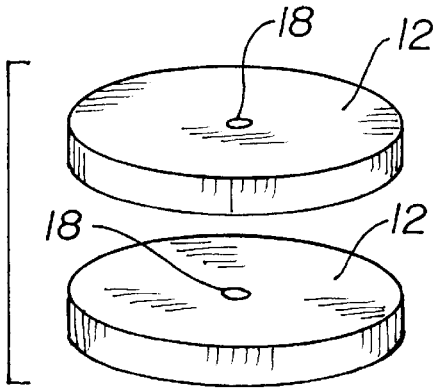
FIG. 1B is a perspective front view of the cold pack components of the preferred embodiment of the invention.

As depicted generally in FIG. 1A, the liner 2 of the preferred embodiment of the invention consists of a substantially cylindrical, hollow structure with an inner sleeve 4 packed with insulating material 6. At its top end, the sleeve 4 includes an outer non-insulated cuff 8 that runs along the entire circumference of the sleeve. The cuff 8 is preferably non-insulated so as to be thin and flexible, allowing it to be readily folded over the lip of a container to secure the liner 2 in place. In addition to the cuff 8, the liner 2 contains a plurality of storage pockets 10 that are sewn or otherwise attached to the inside of the liner. Lastly, the complete kit includes one or more cooling means 12 that are separate from the liner as depicted generally in FIG. 1B.

Figure 1C:
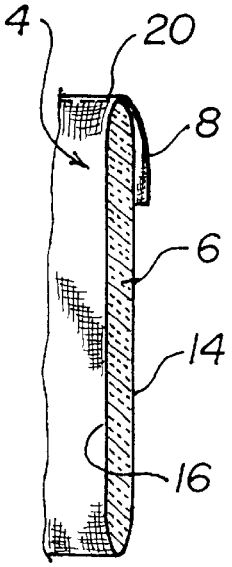
FIG. 1C is a partial cross-sectional view of the top portion of the liner of the invention as seen from line C—C in FIG. 1A.

The inner sleeve 4 of the liner 2 consists of an outer layer 14 and an inner layer 16 that together form an annular cavity within which the insulating material 6 is disposed, as also seen in the cross-section view of FIG. 1C. The sleeve 4 may be inexpensively manufactured out of any lightweight, durable material. Ideally, the material should possess enough strength to withstand the weight of the food or beverage items placed into the attached pockets 10 without ripping. For example, tear-resistant nylon or a similar material may be used with success. Of course, the sleeve 4 may be custom made to fit a variety of container shapes and sizes in addition to the approximately cylindrical design illustrated herein.

The insulating material 6 disposed within the sleeve 4 consists of any lightweight substance of sufficiently low thermal conductivity to maintain a relatively constant temperature within the cooler. Suitable insulating materials may include, for example, urethane foam, Thinsulate®, or Microloft®.

Figure 1D:
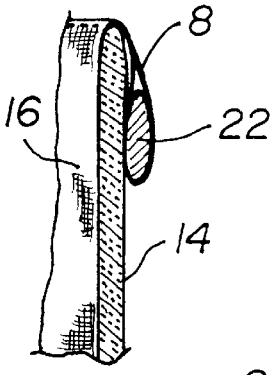
FIG. 1D is an enlarged partial cross-sectional view of the top portion of the liner of the invention showing an annular structure attached to the cuff.

At the top end of the liner 2, the non-insulated cuff 8 conforms to the cylindrical shape of the sleeve 4, so that it may adhere snugly to the top edge of a container over which it is folded. The cuff 8 as seen in FIG. 1A is preferably an integral part of the sleeve 4 that has been separated from the insulating material 6 by a stitched seam 20 along the top edge of the liner so as to remain relatively thin. A flexible annular structure 22 (which may be in the form of an insert), illustrated only in the partial enlarged view of FIG. 1D, may be attached along the perimeter of the cuff 8 to facilitate the process of anchoring the liner 2 in place over the lip of a container. Alternatively, the cuff 8 can be made from any thin, but preferably stiff and flexible material and then attached to the sleeve 4 to achieve the same purpose. The important feature is that the cuff 8 must be easily foldable over the lip of the container intended for use with the liner of the invention and remain in place after installation.

Referring again to FIG. 1B, two preferably disc-shaped cooling packs 12 are used in conjunction with the pocketed liner 2 to achieve the objectives of the invention. The cooling packs 12 may contain a small hole 18 through which a fastener such as an anchor bolt is used to secure one of the cold packs to the lid of the container and the other to its bottom. Obviously, any number of different types of cooling means may be used in practicing the invention, including ice, ice packs, or packs harboring frozen chemicals or liquid coolant.

Figure 2:
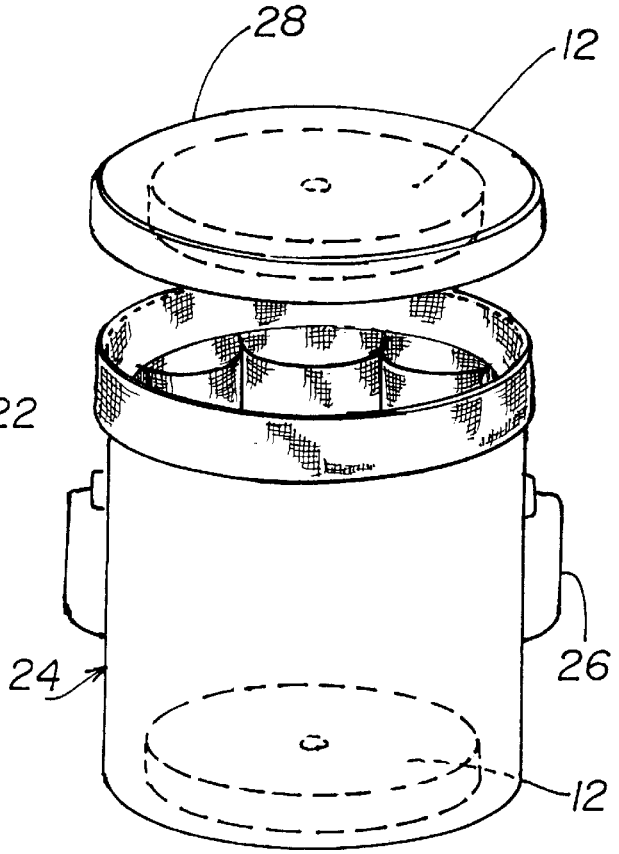
FIG. 2 is a perspective view of the liner and cold pack components (shown in phantom line) of the invention as they would appear installed on a bucket.

As pictured fully-assembled in FIG. 2, securing the liner 2 into a container 24 is accomplished by folding the cuff 8 down so as to cover and extend below the lip of the container 24 but above the carrying handle 26. Because of the flexibility of its material, the liner and its cuff 8 can be folded with relative ease during installation. Moreover, the geometry and stiffness of the cuff 8 ensure that it be either completely unfolded upward or folded downward, and that it remain in that configuration until changed by a user. It is noted that the total thickness of the cuff 8 must be such that it does not interfere with the engagement of a lid 28 with the lip of the container 24.

The storage pockets 10 for receiving and organizing refrigerated items are sewn or otherwise attached to the sleeve 4. The pockets 10 may be constructed in various sizes so as to fit the volume of commonly stored food and beverage items, such as yogurt cups or soda cans.

Alternatively, the pockets 10 may include flaps with fastening means such as Velcro™ or elastic ties (not illustrated) to better secure particularly fragile or loose items.

The pockets 10 themselves may be constructed out of, or have disposed within them, insulation material that would better maintain the temperature for frozen items such as ice cream. The addition of an insulative material also will provide for the cushioning of glass or other breakable containers in the event the cooler is tipped over or dropped.

Figure 3A:
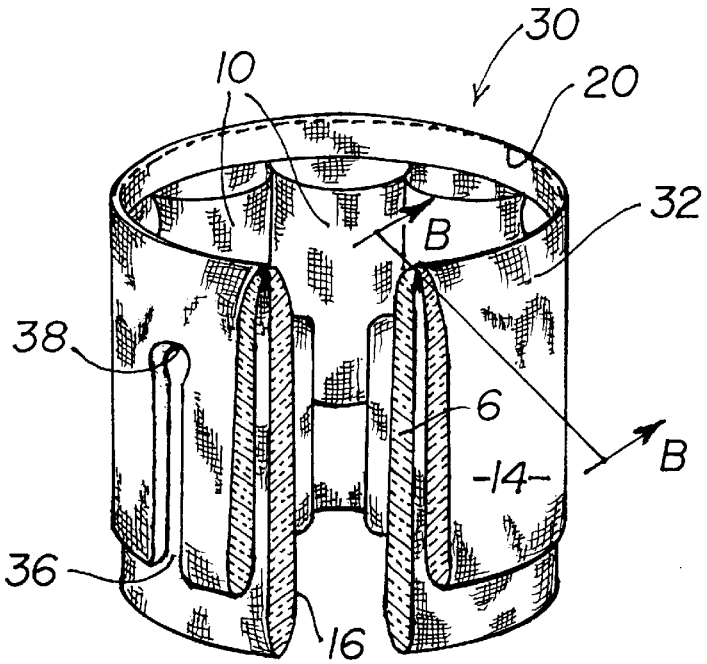
FIG. 3A is a partially cut-away, perspective front view of another embodiment of a liner according to the invention.
Figure 3B:
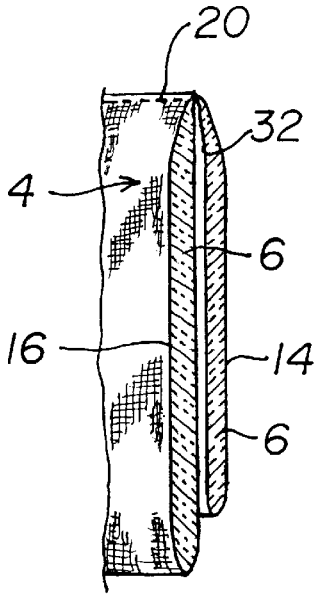
FIG. 3B is a partial cross-sectional view of the top portion of the liner of FIG. 3A as seen from line B—B in that figure.
Figure 4:
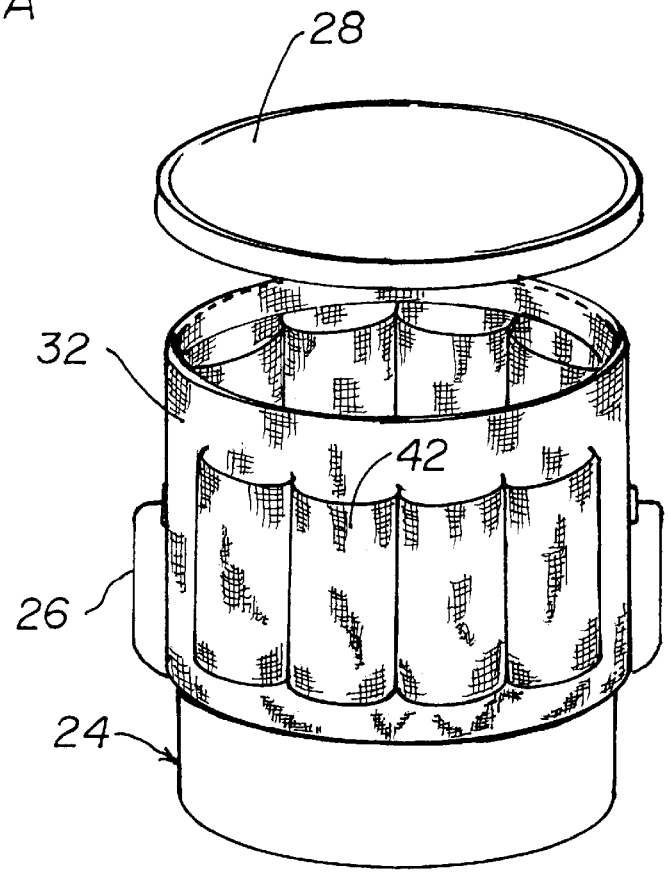
FIG. 4 is a perspective view of the liner of FIG. 3A as it would appear installed on a bucket.

In another embodiment of the invention illustrated in FIGS. 3A, 3B and 4, a liner 32 is constructed with an extended cuff 34 designed to cover the exterior of the bucket 24. In order to improve the insulating properties of the liner of the invention, the longer cuff 34 is also insulated, as seen in the cross-sectional view of FIG. 3B, and it is extended to drape over the bucket 24 and cover most of its exterior surface. The insulated cuff 34 is advantageously constructed by extending the inner and outer layers 14,16 and the insulating material 6 contained between them beyond the stitched seam 20 along the top edge of the liner. Slits 36 with appropriately sized openings 38 are included on opposite sides of the cuff 32 for passing the cuff over the hinges of the handle 26 and allow its normal use, as illustrated in FIG. 4. As also shown in that figure, exterior pockets 42 can be added to the outer cuff 32 to provide storage for additional beverages and like items prior to cooling them inside the container 24. Because of its double insulation, it is expected that this embodiment of the invention would be particularly useful in warm weather. It is also expected that the outer portion of the cuff 32 will be used for displaying advertisements and similar messages of interest.

Thus, as would be understood by those skilled in the art, any number of functional equivalents may exist in lieu of the preferred embodiments described above. Accordingly, changes in the details, steps and materials that have been described may be made within the principles and scope of the invention illustrated herein and defined in the appended claims. For example, although the preferred embodiment of the liner of the invention is depicted as a sleeve, adding a bottom to make the liner sack-like also is envisioned by the inventor. Therefore, while the present invention has been shown and described in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent products and methods.

I claim:

1. A kit for converting a container into a cooler, comprising:

a liner comprising an insulated sleeve conforming to an interior surface of the container;

a cuff connected to said liner and adapted for securing the liner to the container by folding over a lip thereof; and means for cooling the container.

2. The kit of claim 1, wherein said cooling means comprises a cold pack.

3. The kit of claim 1, wherein said cooling means comprises a cold pack adapted for attachment to a lid of said container.

4. The kit of claim 1, further comprising pockets in said inner sleeve for holding refrigerated items.

5. The kit of claim 4, wherein said cooling means comprises a cold pack.

6. The kit of claim 1, wherein said liner is substantially cylindrical.

7. The kit of claim 6, further comprising pockets in said inner sleeve for holding refrigerated items.

8. The kit of claim 6, wherein said cooling means comprises a cold pack.

9. The kit of claim 7, wherein said cooling means comprises a cold pack.

10. The kit of claim 6, further comprising a flexible annular structure attached to the cuff of the liner.

11. A make-shift cooler comprising:

a container with a lid;

a liner comprising an insulated sleeve conforming to an interior surface of the container;

a cuff connected to said liner and adapted for securing the liner to the container by folding over a lip thereof; and means for cooling the container.

12. The cooler of claim 11, wherein said cooling means comprises a cold pack.

13. The cooler of claim 11, wherein said cooling means comprises a cold pack adapted for attachment to the lid of the container.

14. The cooler of claim 11, further comprising pockets in said inner sleeve for holding refrigerated items.

15. The cooler of claim 14, wherein said cooling means comprises a cold pack.

16. The cooler of claim 11, wherein said container and liner are substantially cylindrical.

17. The cooler of claim 16, further comprising pockets in said inner sleeve for holding refrigerated items.

18. The cooler of claim 16, wherein said cooling means comprises a cold pack.

19. The cooler of claim 17, wherein said cooling means comprises a cold pack.

20. The cooler of claim 16, further comprising a flexible annular structure attached to the cuff of the liner.

* * * * *